US007699091B2

(12) United States Patent
Fisher, Sr. et al.

(10) Patent No.: US 7,699,091 B2
(45) Date of Patent: Apr. 20, 2010

(54) AWNING SYSTEM WITH SNAP-ON FUNCTIONAL COMPONENTS

(75) Inventors: Larry Fisher, Sr., Marietta, GA (US); Larry Fisher, Jr., Woodstock, GA (US); West Fisher, Canton, GA (US)

(73) Assignee: Steel Stitch Corporation, Kennesaw, GA (US)

( * ) Notice: Subject to any disclaimer, the term of this patent is extended or adjusted under 35 U.S.C. 154(b) by 9 days.

(21) Appl. No.: 12/120,985

(22) Filed: May 15, 2008

(65) Prior Publication Data

US 2008/0307716 A1 Dec. 18, 2008

Related U.S. Application Data

(63) Continuation of application No. 10/916,119, filed on Aug. 11, 2004, now abandoned.

(60) Provisional application No. 60/554,255, filed on Mar. 18, 2004, provisional application No. 60/494,265, filed on Aug. 11, 2003.

(51) Int. Cl.
*A47H 13/00* (2006.01)

(52) U.S. Cl. ..... 160/397; 160/393; 160/396; 38/102.91; 52/222; 49/462

(58) Field of Classification Search ..... 52/74, 52/63, 202, 273, 511, 222, 718.04; 160/378, 160/391, 395, 397, 383, 393, 394, 396, 392; 38/102.91; 49/462

See application file for complete search history.

(56) References Cited

U.S. PATENT DOCUMENTS 2,287,667 A 6/1942 Brown
2,834,412 A 5/1958 Velke
3,357,681 A 12/1967 Souza, Jr.
3,508,369 A 4/1970 Tennison
D218,295 S 8/1970 MacLellan et al.

(Continued)

OTHER PUBLICATIONS

Steel Stitch—Awning, Canopy & Sign Supply Catalog—Jan. 1998.

(Continued)

*Primary Examiner*—Richard E Chilcot, Jr.
*Assistant Examiner*—Chi Q Nguyen
(74) *Attorney, Agent, or Firm*—Womble Carlyle Sandridge & Rice, PLLC

(57) ABSTRACT

An improved staple-in fabric awning system is provided. The awing has a frame made of ribs with outwardly exposed longitudinally extending staple slots. A fabric canopy covers the frame and is tucked into and secured within the staple slots. A vinyl strip is configured to snap into the staple slots of the awning atop the canopy to span and hide the tucked in portions and cover the staples therein. The vinyl strip is covered at least on its exposed top portion with fabric that may visually blend into the fabric of the canopy or that may visually contrast with the fabric of the canopy. The system includes snap-in and snap-on plastic perimeter flanges and out rod flanges that are mounted on the perimeter ribs and out rods that form a grid on the underside of the awning. The plastic flanges form inwardly projecting lips around the openings of the underside grids that support egg crate ceiling panels to form an aesthetically pleasing underside ceiling of the awning.

12 Claims, 11 Drawing Sheets

U.S. PATENT DOCUMENTS

| | | | | | |
|---|---|---|---|---|---|
| 3,559,357 | A | | 2/1971 | Lowe | |
| 3,834,104 | A | | 9/1974 | Dunn et al. | |
| 4,189,880 | A | | 2/1980 | Ballin | |
| 4,193,235 | A | | 3/1980 | Cucchiara | |
| 4,231,141 | A | | 11/1980 | Derrick et al. | |
| 4,233,790 | A | | 11/1980 | Meadows | |
| 4,272,073 | A | | 6/1981 | Grosser et al. | |
| 4,410,027 | A | * | 10/1983 | Lucous | 160/380 |
| 4,690,192 | A | | 9/1987 | Stilling | |
| 4,694,543 | A | * | 9/1987 | Conley | 24/461 |
| 4,718,213 | A | | 1/1988 | Butterfield | |
| 4,726,869 | A | | 2/1988 | Matsui et al. | |
| 4,759,087 | A | | 7/1988 | Zeilinger | |
| 4,817,655 | A | | 4/1989 | Brooks | |
| 4,845,916 | A | | 7/1989 | Villard | |
| 4,926,605 | A | | 5/1990 | Milliken et al. | |
| D309,351 | S | | 7/1990 | Patsy, Jr. | |
| 4,947,561 | A | * | 8/1990 | Delacroix et al. | 38/102.91 |
| 5,044,131 | A | | 9/1991 | Fisher | |
| 5,172,743 | A | | 12/1992 | Wallace et al. | |
| 5,209,029 | A | | 5/1993 | Foerst | |
| 5,224,306 | A | | 7/1993 | Cramer | |
| 5,237,785 | A | | 8/1993 | Lukes | |
| 5,242,004 | A | | 9/1993 | Stilling | |
| 5,259,323 | A | | 11/1993 | Koch et al. | |
| 5,291,705 | A | | 3/1994 | Dickerson | |
| 5,469,672 | A | | 11/1995 | Fisher | |
| 5,514,432 | A | | 5/1996 | Lisec | |
| 5,555,695 | A | | 9/1996 | Patsy, Jr. | |
| 5,577,352 | A | | 11/1996 | Fisher | |
| 5,713,108 | A | | 2/1998 | Solomon et al. | |
| 5,791,115 | A | | 8/1998 | Nicolai et al. | |
| 5,794,400 | A | | 8/1998 | Fisher et al. | |
| 5,906,078 | A | | 5/1999 | Cramer | |
| 6,321,397 | B1 | | 11/2001 | Fogg et al. | |

OTHER PUBLICATIONS

Eastern Awning Systems, Inc.—Maxi Window Awning Brochure.
The William L. Bonnell Company, Inc., Newnan, GA—Brochure Apr. 11, 1988.
Steel Stitch System Represents the Future of Fabric Structure Design—10536/STE BuyLine 9416.
Breakthrough to The Next Century with the Power of Steel Stitch—Brochure.
Steel Stitch Corporation—Manufacturers of The Perfect Awning Frame—Apr. 1993—pp. 1-16.

* cited by examiner

AWNING SYSTEM WITH SNAP-ON FUNCTIONAL COMPONENTS

REFERENCE TO RELATED APPLICATIONS

This is a continuation of U.S. patent application Ser. No. 10/916,119 filed on Aug. 11, 2004, now abandoned which, in turn, claims priority to the filing dates of U.S. provisional patent application Nos. 60/494,265 filed Aug. 11, 2003 and 60/554,255 filed Mar. 18, 2004.

TECHNICAL FIELD

This invention relates generally to awnings and canopies, and more specifically to so called staple-in fabric awnings, canopies, and other framed fabric structures having a metal frame or skeleton covered by fabric.

BACKGROUND

So-called staple-in awning frames, across which canvas or other cloth material is stretched to form an awning, canopy, or other framed fabric structure, have become popular in recent years (the term "awning" will be used hereinafter to encompass all such structures). In general, a staple-in awning frame is fabricated with metal ribs that form the skeleton of the awning. At least some of the ribs, which generally are square or rectangular in shape, have a slot along their outside edges and a staple deck recessed within the slot. When a cloth material is stretched over the frame, it is tucked into the slots of the frame ribs and staples are driven through the cloth and through the staple deck to secure the material to the ribs. Once the cloth material is attached in this way, lengths of plastic or vinyl filler strips are snapped into the slots to hide the staples, cover the slots, and form an aesthetically pleasing appearance. This method of fabricating cloth awnings has proven superior to old tie-on and other methods.

In many cases, fabric awnings are provided with ceiling panels that are mounted in the underside rib grid of the awning to hide internal awning structure and provide an aesthetically pleasing undesired appearance. Often, these ceiling panels are made of so-called egg crate, which is a molded plastic panel formed with crisscrossed ribs that define a multitude of small square openings. Florescent lighting fixtures in suspended ceilings often employ such egg crate panels to diffuse the light and hide the florescent bulbs of the fixtures. When mounting egg crate panels in the underside of a staple-in awning, an inwardly extending lip or ledge must be provided around the grid openings formed by the ribs of the awning's underside. The panels are then mounted in the openings, where they are supported around their perimeter edges by the lips in much the same way that suspended ceiling panels are mounted within the grid of a suspended ceiling.

In the past, the lips for supporting ceiling panels in fabric awnings have been formed by awning installers in a variety of ways. Installers have been known, for instance, to rivet or screw strips of aluminum along the bottoms of the underside ribs of the awning to form lips. Manufacturers of awing rib stock also offer a variety of specialized extruded ribs that have the lip structure unitarily formed with the rib itself. These and other prior methods of forming the lips that support ceiling panels in fabric awnings have inherent problems. For example, ribs formed "on the fly" by attaching aluminum strips to the awning ribs often are considered unattractive, can be labor and time intensive to install, and provide no means for securely holding ceiling panels in place. Extruded ribs with pre-formed lips structures look better, but require that an inventory of specialized ribs for this purpose be fabricated, stocked, ordered, and shipped. In either case, lips made of aluminum or other metal do not match the white color of the egg crate ceiling panels, do not provide a clean perimeter around the underside of the awning, and are considered by some to be unsightly.

There exists a need for an awning system that addresses and solves the above and other problems and shortcomings. It is to the provision of such an awning system that the present invention is primarily directed.

SUMMARY OF THE INVENTION

Briefly described, the present invention, in one preferred embodiment thereof, comprises an improved staple-in awning system for the fabrication of awnings with suspended underside ceiling panels. The system eliminates the need for specially profiled ribs for the awning underside so that standard staple-in ribs can be used around the perimeter of the awning underside and standard square ribs called "out rods" form the underside grid structure. In the awning system of this invention, the ribs around the perimeter of the awning underside are oriented with their staple slots facing down and the fabric of the awning is stretched cleanly around the perimeter ribs and stapled in from the bottom. Snap-in plastic or vinyl perimeter flanges are then snapped into the slots. The perimeter flanges are profiled so that they cover and hide the slots and staples to provide a clean appearance and also form an inwardly projecting lip that extends around the perimeter of the awning underside. Snapfitting extruded plastic sheaths or retainer clips are mounted on the tops of the out rods of the awning underside and are designed to capture and hold out rod flanges that extend along the bottoms of the out rods. Specifically, out rod flanges are attached to the out rods by pressing them on the out rods from the bottom, whereupon they snap to the pre-installed retainer clips to secure the out rod flanges in place on the out rods. The out rod flanges and perimeter flanges are profiled to define lower lips that project into the openings of the grid formed by the perimeter ribs and out rods of the awning underside.

When the perimeter flanges and out rod flanges are in place, they form plastic lips or ledges around each opening of the underside grid structure of the awning. Egg crate, or other types of ceiling panels, can then be mounted within the grid openings, where they are supported by the lips. In one embodiment, the retainer clips on the out rods also are formed with hold down flanges that extend over the perimeter edges of the panels to hold the panels in place and prevent them from being blown or pushed out of the grid openings. In any event, the snap-in perimeter flanges and out rod flanges preferably are formed from plastic or vinyl of the same color as the ceiling panels to provide a uniform and aesthetically pleasing ceiling for the underside of the awning.

Thus, an improved fabric awning system is now provided in which a uniform clean looking underside ceiling structure can be installed quickly and easily without the need for specially profiled rib stock and without unacceptable improvised solutions such as attaching aluminum strips to the underside ribs. These and other advantages and features will become more apparent upon review of the detailed description set forth below taken in conjunction with the accompanying drawing figures, which are briefly described as follows.

DETAILED DESCRIPTION OF THE PREFERRED EMBODIMENTS

Figure 1:
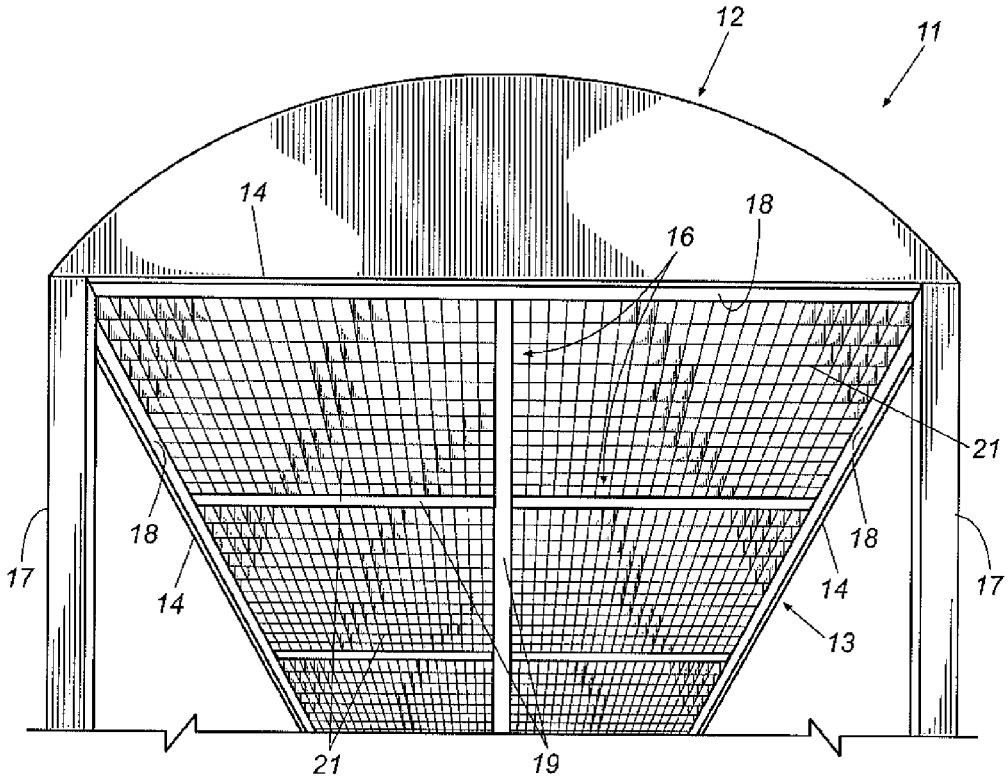
FIG. 1 is a perspective view of a staple-in fabric awning system that embodies principles of the present invention in one preferred form.

Referring now in more detail to the drawing figures, wherein like reference numerals refer, where appropriate, to like parts throughout the several views, FIG. 1 illustrates a typical staple-in fabric awning, which embodies principles of the invention. It will be understood that a virtually unlimited variety of awning configurations are possible, the configuration of FIG. 1 being a simple awning illustrated for clarity. The present invention is applicable to all configurations. The awning 11 is formed from a skeleton of metal ribs (largely not visible in FIG. 1) over which is stretched a fabric material to form the awning as known in the art.

The awning 11 has an upper portion or canopy 12 and an underside 13. The perimeter of the underside 13 is rimmed by perimeter ribs 14 and several out rods 16, which are welded or otherwise attached to the perimeter ribs. The perimeter ribs and out rods together form a grid on the underside of the awning. In many cases, the grid forms square or rectangular openings; however, openings having virtually any shape are possible and sometimes used for decorative effect or in odd-shaped awnings. The openings may be any size, but, in one embodiment of the present invention, preferably are about 2 feet by 2 feet or 2 feet by 4 feet in order to accommodate standard size egg crate ceiling panels, as described in more detail below. The awning 11 may, in some installations, be supported by vertical support posts 17, or, alternatively, may simply be supported by a building to which the awning is attached.

Extruded plastic perimeter strips or perimeter flanges 18 are snapped in place, as detailed below, and extend along the bottoms of the perimeter ribs 14 around the outside of the awning bottom. Similarly, extruded plastic out rod strips or flanges 19 are mounted to the out rods 16. As explained in more detail below, the perimeter flanges and out rod flanges together form inwardly extending lips that extend around the perimeter of each opening of the awning's underside grid structure. Ceiling panels 21, which in this embodiment are standard egg crate ceiling panels, are mounted in the openings of the grid in much the same way as the ceiling panels of a suspended ceiling. The ceiling panels 21 are supported around there peripheral edges on the inwardly extending lips formed by the perimeter flanges 17 and out rod flanges 19. Preferably, but not necessarily, the perimeter flanges and out rod flanges are formed from plastic or vinyl having the same color as the egg crate ceiling panels, usually white. In this way, the ceiling panels together with the perimeter flanges and out rod flanges form an underside ceiling of the awning that is clean and visually attractive and, at the same time, is simple and easy to install without improvising and without the need for specially configured awning ribs.

Figure 2:
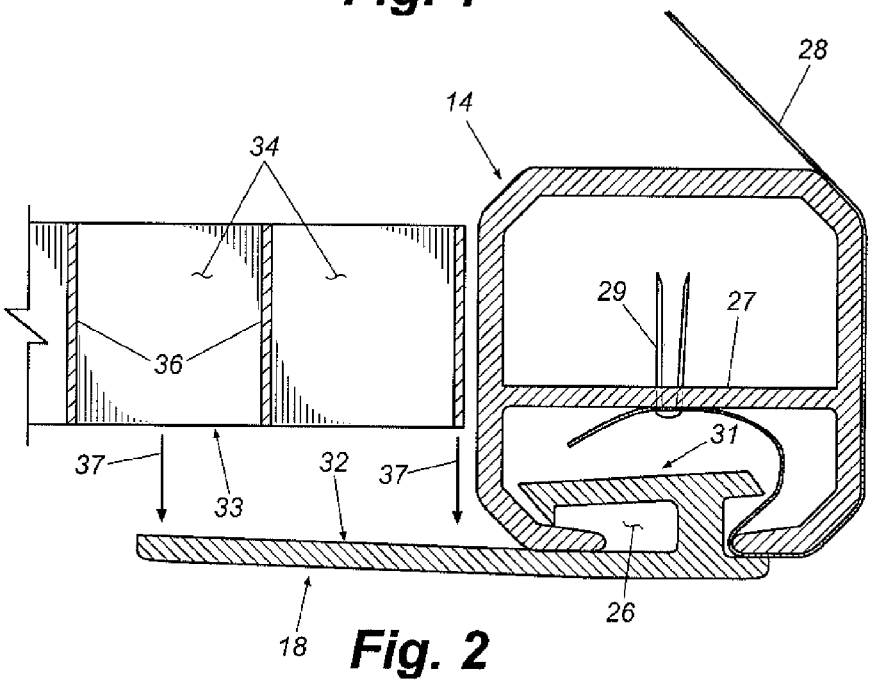
FIG. 2 is a cross sectional view of a perimeter rib of the awning system illustrating the snap in perimeter lip and its supporting relationship with an egg crate ceiling panel.

FIG. 2 is an enlarged cross sectional view of the perimeter rib portion of the awning 11. The perimeter rib 14 may be any standard staple-in awning rib and generally is square or rectangular in shape having a staple slot 26 formed along one side. The perimeter rib 14 may, for instance, be an extruded aluminum rib, a roll formed steel rib, a combination steel and aluminum rib, or any other type of rib used in staple-in awning construction. A staple deck 27 is recessed within the staple slot 26 in the customary manner. For the present invention, the perimeter rib is oriented with its staple slot facing downwardly. The fabric 28 of the awning is stretched around the outside edge of the of the perimeter rib and extends into the staple slot 26, where it is firmly attached with staples 29 driven through the fabric 28 and through the staple deck 27. This is the customary way of attaching awning fabric to the ribs of a staple-in awning assembly.

According to principles of this invention, the extruded plastic perimeter flange 18 is attached along the underside of the perimeter rib by being snapped into place within the staple slot 26. More specifically, a generally T-shaped (in this particular embodiment) attachment tab 31 is formed on the perimeter flange and is sized and shaped so that it can be pressed into the slot with an appropriate tool. Once pressed in, the top legs of the attachment tab 31 spring out to grip the inside portions of the slot lips and thus hold the perimeter flange securely in place extending along the perimeter rib. The plastic perimeter flange 18 is further formed with an extension 32 that projects inwardly from the bottom surface of the perimeter rib as shown. The extension forms an inwardly extending lip with respect to the perimeter rib. The lip is sized and shape to support one edge portion of a ceiling panel 33 mounted in the underside of the awning as described above. In one embodiment, the ceiling panel 33 is of the egg crate type, being formed with crisscrossing ribs 34 and 36 that define a multitude of small square openings through the panel. It will be understood, however, that the present invention is not limited to an egg crate ceiling panel, but is applicable to any type of panel that one may wish to install in the underside of the awning. In any event, the ceiling panel 33 is mounted in the awning by being inserted through an opening in the underside grid and positioned on the supporting lips, as illustrated by arrows 37.

Figure 3:
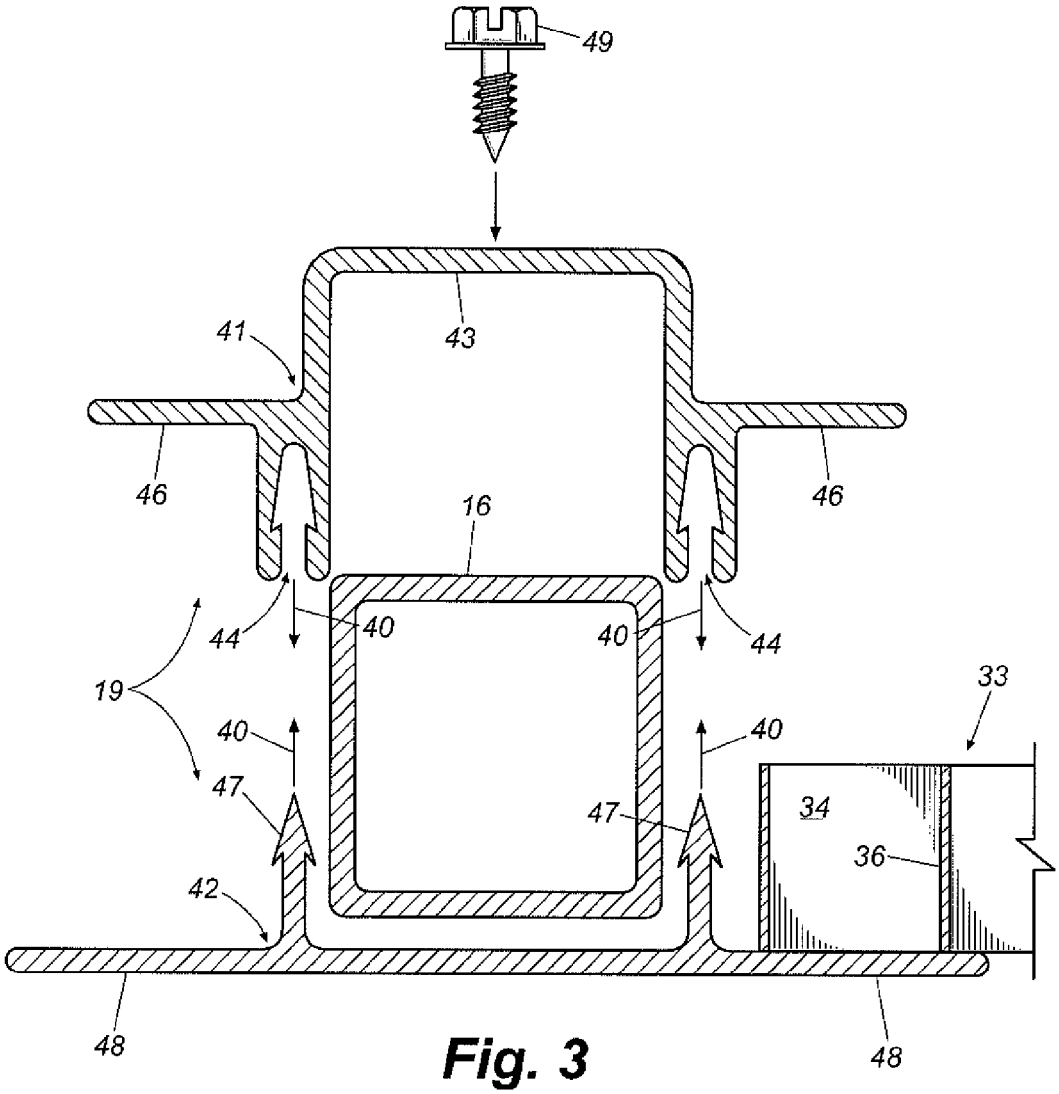
FIG. 3 is an exploded cross sectional view of an out rod of the awning structure showing one embodiment of a retainer clip and out rod flange that forms lips along the out rods for supporting egg crate ceiling panels.
Figure 4:
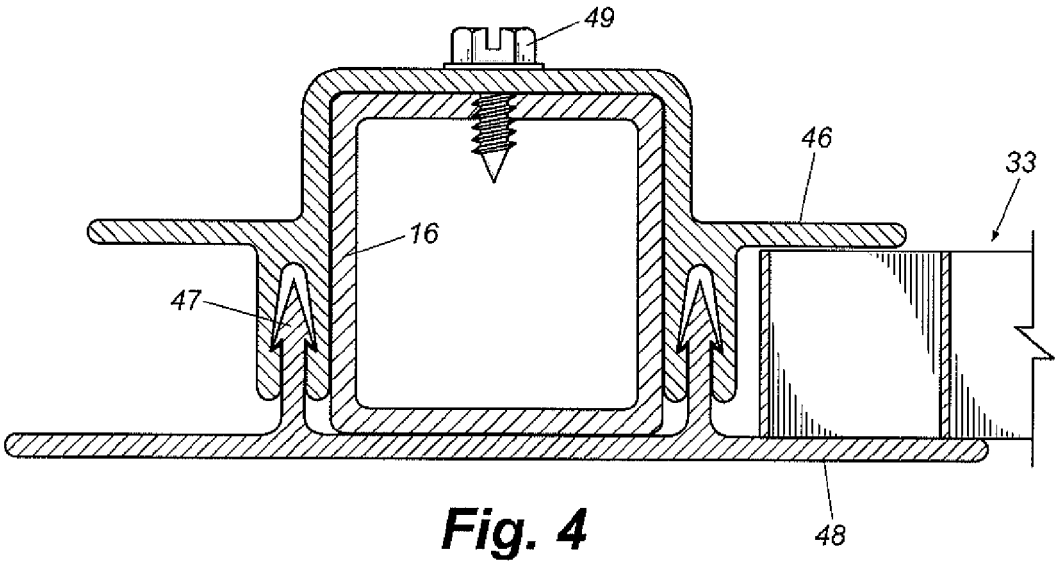
FIG. 4 is a cross sectional view of an out rod with the retainer clip securing an out rod flange and with the edge of an egg crate ceiling panel supported and held down by the retainer clip.

FIG. 3 illustrates one possible configuration of the extruded plastic out rod flanges that form a part of the present invention. The out rod flange 42 is seen to be formed with outwardly extending lips 48 for supporting a ceiling tile, such as egg crate ceiling tile 33. The out rod flange is further formed with upwardly projecting barbed tangs 47 spaced to straddle and out rod 16. A retainer clip 41 is configured to be installed on the out rod 16 from the top and has downwardly facing slots or clips 44 that are spaced to align with the barbed tangs 47 of the out rod flange 42. When retainer clips 41 are installed along the top of an out rod and out rod flanges installed from the bottom of the out rod, as indicated by arrows 40, the barbed tangs of the out rod flanges snap into the downwardly facing slots of the retainer clip to hold the out rod flanges in place on the out rods. It will thus be seen that the out rod flange 42 and retainer clip 41 are configured to be snapped together around the out rod, as best illustrated in FIG. 4. When mounted on the out rod in this way, the lips 48 of the out rod flange 42 provide support for the peripheral edge of a ceiling panel, such as egg crate panel 33.

FIG. 4 illustrates the out rod flange snapped to the retainer clip and thereby securely attached around the out rod 16. As mentioned above, when the out rod flange is so mounted to the out rod, the lips 48 of the lower section project from the bottom of the out rod into an opening of the underside grid formed by the perimeter ribs and out rods to provide supports for an egg crate or other ceiling panel 33 mounted in the opening. Further, hold down flanges 46 formed as a part of the retainer clip extend over the top of the ceiling panel periphery, thus securely holding the perimeter of the panel in place on the lips. This insures that the ceiling panels are securely held in place and will not be blown up or otherwise easily displaced from the grid openings in which they are mounted.

When installing the out rod flanges on their out rods, it has been found advantageous first to mount the retainer clips, be they continuous or short clips, on the tops of their respective out rods and secure them with sheet metal screws 49. The ceiling panels 33 can then be moved into position in their grid openings, whereupon the bottom sections of the out rod flanges can simply be moved up and snapped into place on the bottoms of the out rods. Of course, this method of installation of the underside ceiling panels of the awning is only one example and not limiting. Other installation methods are possible and considered to be part of the invention. Indeed, the retainer clips may be formed without the hold down flanges. In such a configuration, all of the perimeter flanges and out rod flanges may be installed first, whereupon the ceiling panels can simply be installed in the same way as ceiling panels of a suspended ceiling. Such a configuration may be selected in scenarios, such as indoor awnings for example, where the risk that the ceiling panels will be blown out of place is low and there is little need for the panels to be held down. These and other configurations and installation techniques are considered to be within the scope of the invention.

Figure 5:
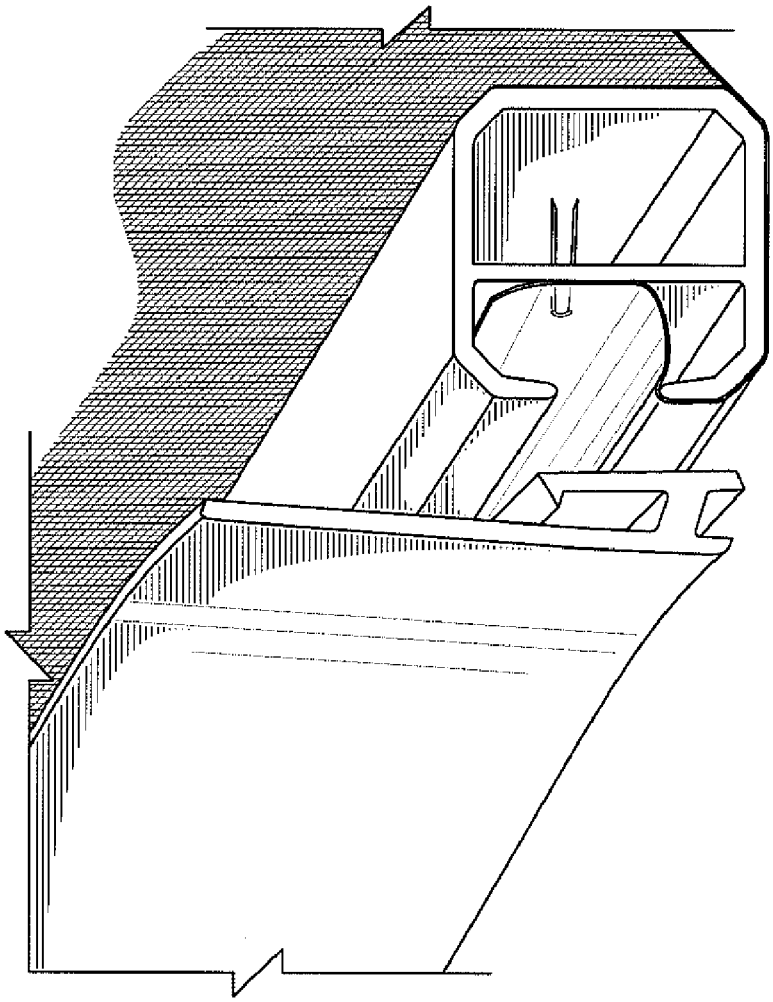
FIG. 5 is a perspective view showing a prototype of a perimeter flange embodying principles of the invention.
Figure 6:
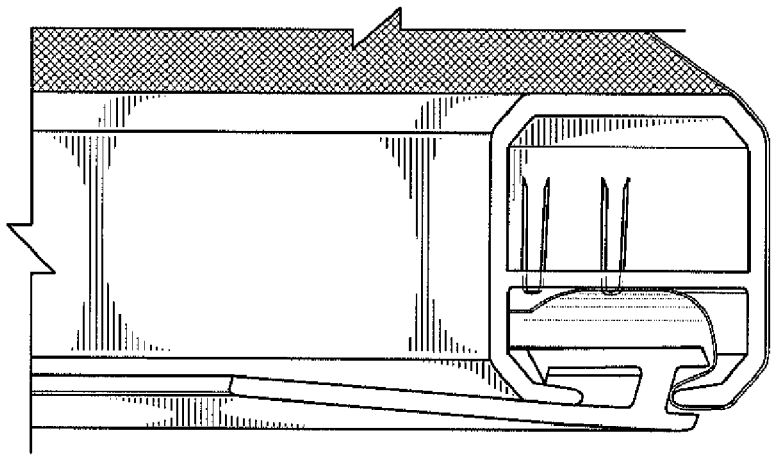
FIG. 6 is an end view showing the prototype perimeter flange snapped into place within the slot of a perimeter rib and supporting an egg crate ceiling panel.

FIG. 5 is a perspective view showing a prototype of the plastic or vinyl perimeter flanges of the present invention. A roll formed perimeter rib is illustrated with its staple slot facing downwardly and awning fabric extending into the slot, where it is attached with staples extending through the staple deck. A plastic perimeter flange according to one embodiment of the invention is seen with its attachment tabs positioned to be snapped into the staple slot to secure the flange to the bottom of the perimeter rib. The tabs thus hold the perimeter flange securely in place with its ceiling panel support lip extending outwardly into an adjacent underside grid opening of an awning. FIG. 6 is an end view similar to FIG. 2 showing the plastic perimeter flange snapped into place within the staple slot with the periphery of an egg crate ceiling panel supported on the lip according to the invention.

Figure 7:
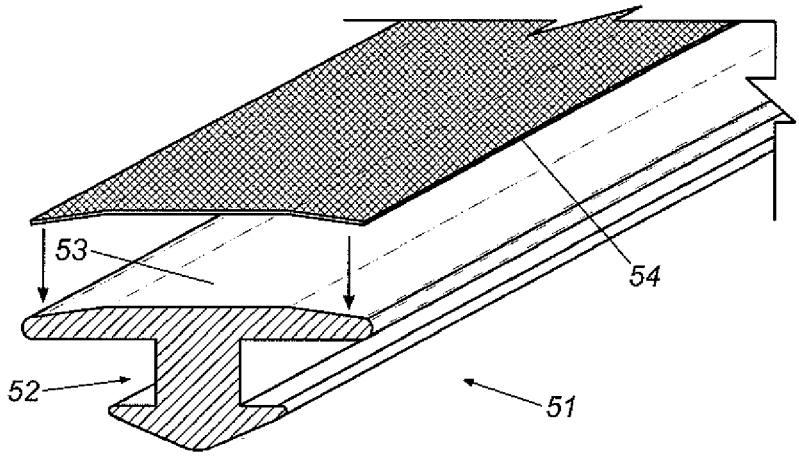
FIG. 7 is a perspective exploded view of a fabric covered vinyl strip for covering the staple slots of fabric awnings that embodies another aspect of the present invention.

FIG. 7 illustrates one embodiment of yet another aspect of the present invention. When fabric awnings are fabricated, the fabric that stretches over the top of the awning is attached at periodic intervals to the awning ribs by being tucked into the staple slots of the ribs and stapled in place. In order to cover the resulting discontinuities in the fabric and to cover the staples, plastic or vinyl strips traditionally are snapped into place within the slots. However, for some installations, the appearance of the plastic strips is objectionable. To address this problem, the present invention, as illustrated in FIG. 7, includes an improved vinyl strip. The strip 51 is formed, in the traditional way, with a depending barbed tang 52 configured to snap securely within a staple slot, and a top portion 53 that spans and covers the slot and the staples within. Unlike prior art strips, however, the strip of this invention is provided with a fabric cover 54 that is sewn, bonded, or otherwise fixed to the upper surface of the top portion of the strip. The fabric cover 54 usually is made of the same material as the awning fabric. In this way, the periodic strips blend cleanly into the background fabric and become virtually invisible, thus providing the appearance of an continuous fabric surface on the awning. In some cases, it may be desired to provide strips that contrast with the awning fabric. In these cases, the fabric covers 54 can have a color and or texture that contrasts with that of the awning fabric. In any event, providing the vinyl strips with a cloth cover is a unique solution to objections by some to bare vinyl strips on awnings. The cloth covers can be fixed to the vinyl strips in any acceptable manner. Preferably, as described in more detail below, they are wrapped around the top portions of the vinyl strips and sewn in place with a commercial dual needle sewing machine. They also may, for example, be bonded with adhesive or they may be sonically or thermally welded. Any acceptable method of attaching the cloth covers to the vinyl strips is considered to be encompassed by the present invention.

FIGS. 8 through 18 illustrate alternate embodiments of some of the elements described in detail above relative to FIGS. 1-7 and are largely self explanatory in view of the forgoing discussion. Accordingly, these figures will be described only briefly here, since their function and configuration will be clear to those of skill in the art.

Figure 8:
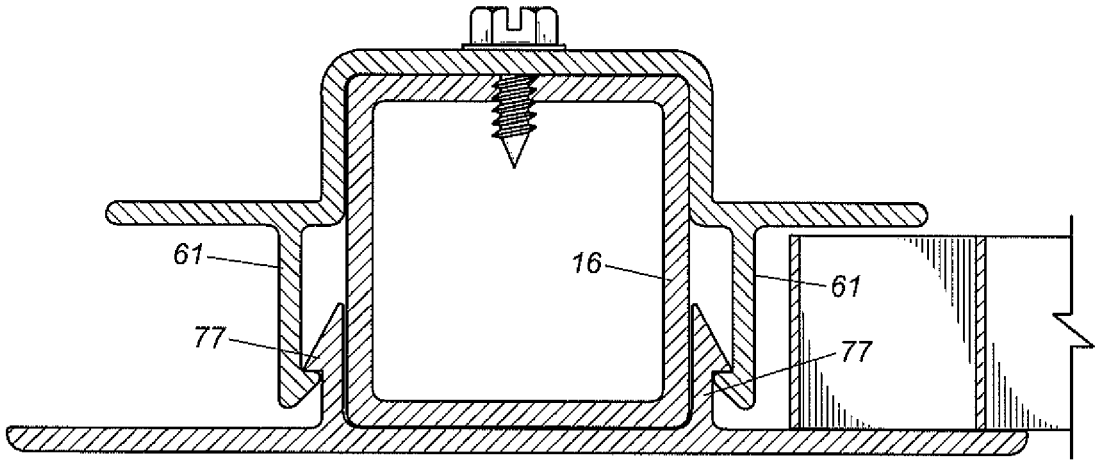
FIG. 8 is a cross-sectional view of an alternate embodiment of an out-rod flange and retainer clip according to the invention.

FIG. 8 is a cross-sectional view of an alternate embodiment of an out rod flange and retainer clip for mounting out rod flanges on the out rods of an awning frame. The function of the embodiment of FIG. 8 is essentially the same as that of FIG. 3; however, one of the downwardly depending legs forming slots 44 in FIG. 3 has been eliminated, Instead, the upwardly projecting tangs 77 in this embodiment are captured between the wall of an out rod 16 and the single downwardly projecting leg 61 of the retainer clip. This configuration performs equally as well as the embodiment of FIG. 3 and can be fabricated using less plastic.

Figure 9A:
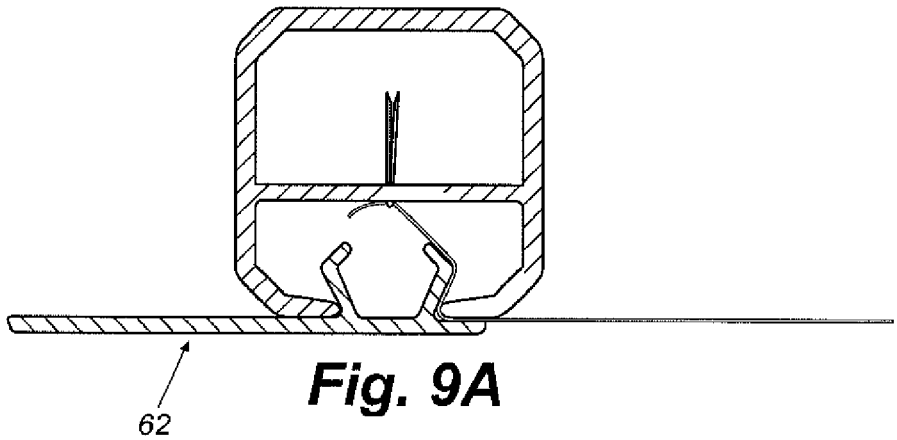
FIGS. 9A through 9I illustrates various alternate embodiments of perimeter flanges attached to perimeter rods according to the invention illustrating alternate methods of attaching the flange to perimeter rods.
Figure 9B:
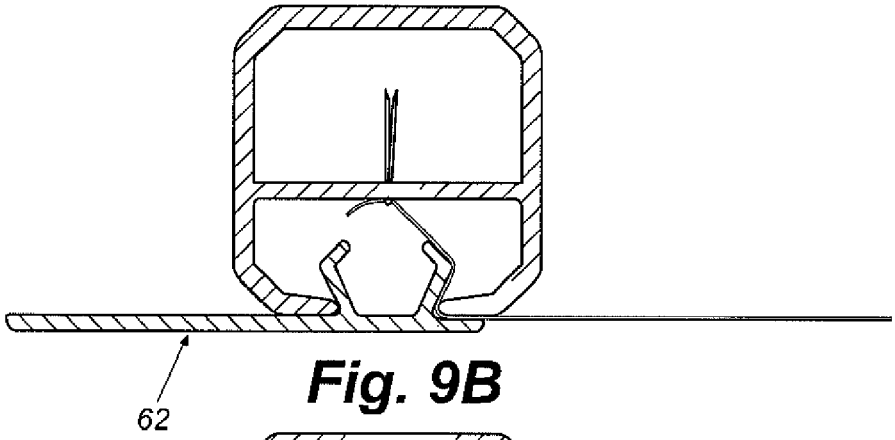
Figure 9C:
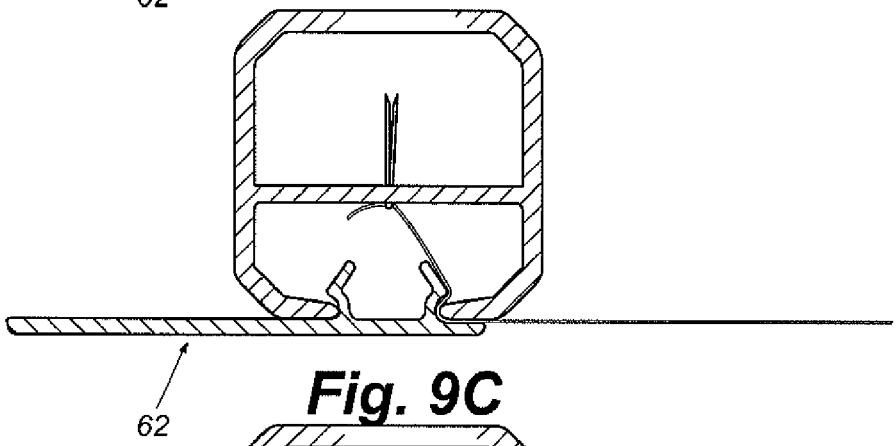
Figure 9D:
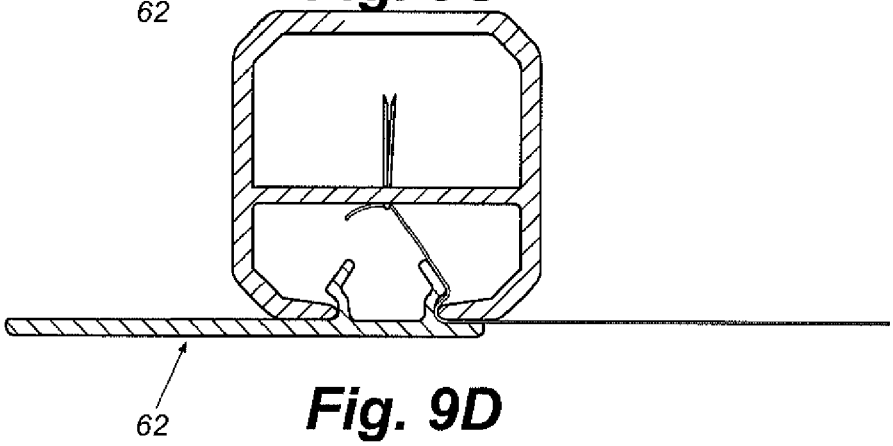
Figure 9E:
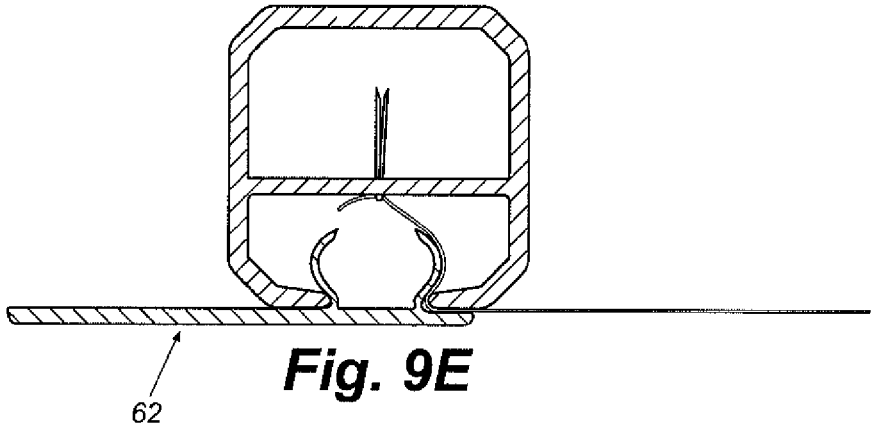
Figure 9F:
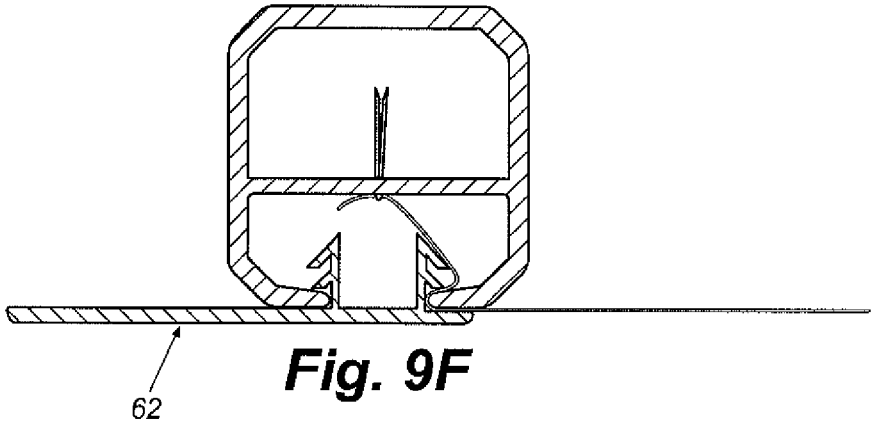
Figure 9G:
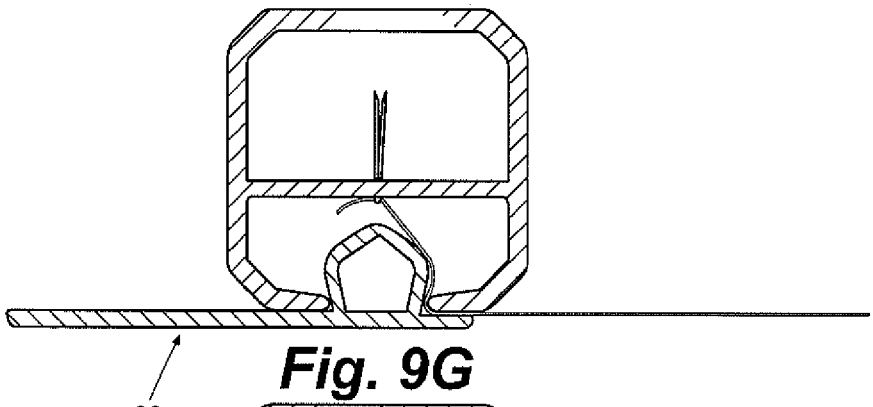
Figure 9H:
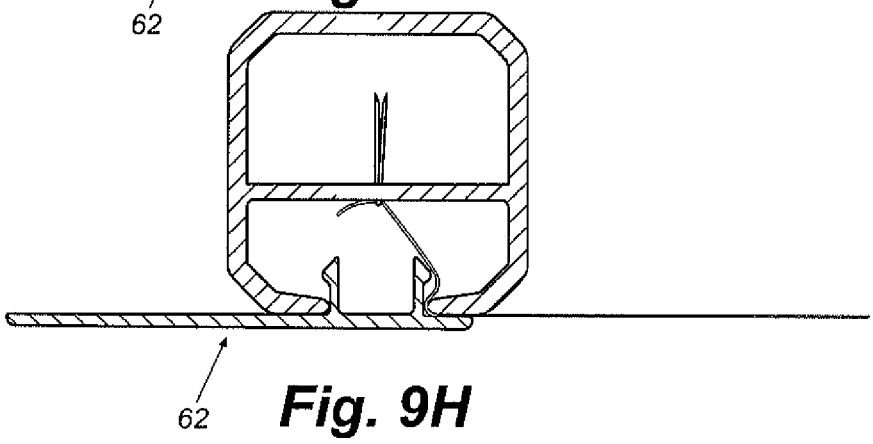
Figure 9I:
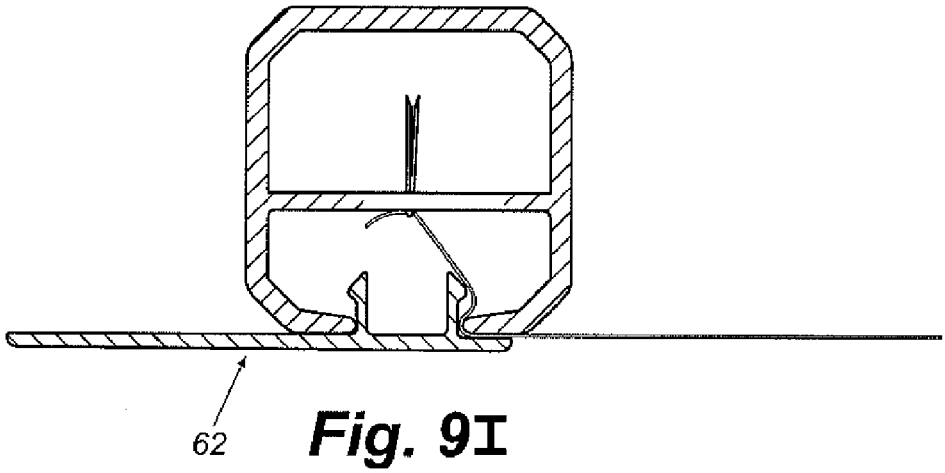

FIG. 9A through 9I illustrate various alternate embodiments of a perimeter flange 62 and specifically illustrate various possible configurations of the snap-in tabs of the flanges that allow them to be snapped into the staple slots of perimeter ribs of an awning. It will be understood that the illustrations of FIGS. 9A-91 are shown upside down and that, in reality, the perimeter flanges are attached to the bottoms of the perimeter ribs in a typical installation.

Figure 10:
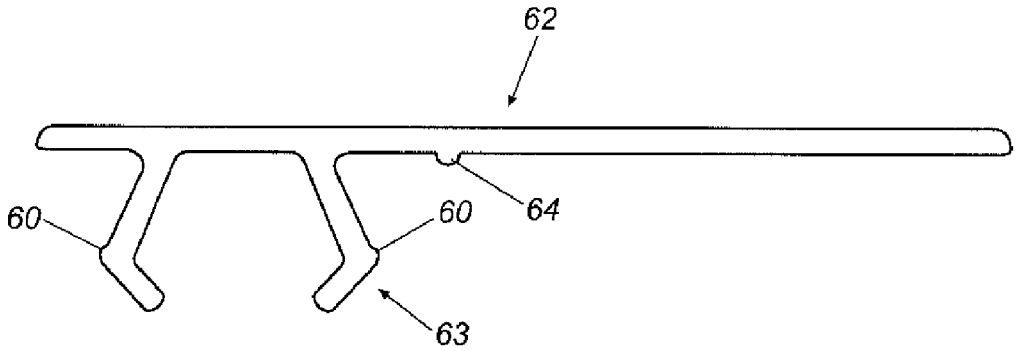
FIG. 10 is a cross-sectional view of a perimeter flange that embodies principles of the invention in an alternate form.

FIG. 10 is a detailed cross section of a perimeter flange that embodies principles of the invention in a particularly preferred form, and that illustrates what the inventors believe is the best mode of carrying out the invention. The perimeter flange 62 is formed of extruded plastic and includes spring biased snap-in tabs 63 that include nibs 60, which reside just under the inner lip of a staple groove to hold the perimeter flange firmly to the perimeter ribs of an awning system. An elongated spacing nub 64 is provided on the upper surface of the inwardly extending lip to compensate for the thickness of fabric on the other side of the snap-in tabs to insure that the flange extends inwardly in a horizontal orientation rather than being cocked upwardly.

Figure 11:
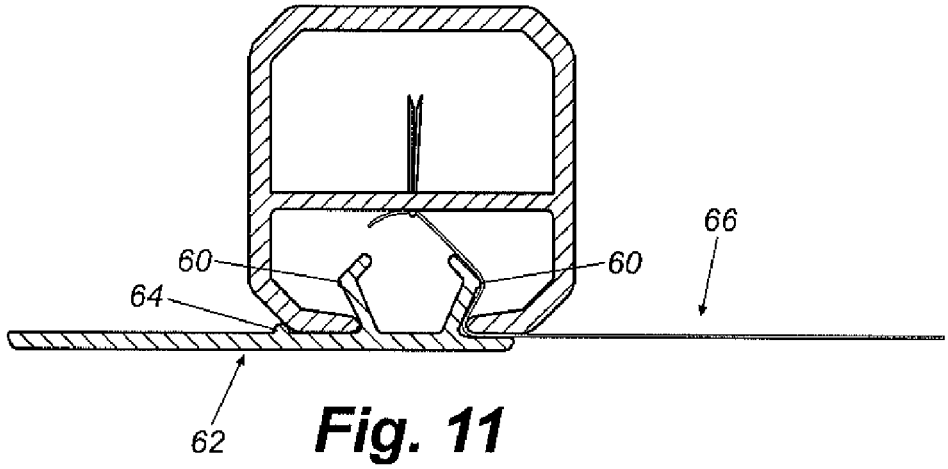
FIG. 11 is a cross-sectional view of a perimeter flange according to the embodiment of FIG. 10 attached to the bottom of a perimeter rib.

FIG. 11 is a cross-sectional view of the perimeter flange of FIG. 10 shown snapped into the staple groove of a perimeter rib. Fabric 66 is shown attached to the perimeter rib and secured by staples driven through the fabric and staple deck, as discussed in more detail above. The nibs 60 are seen to extend just inside or under the inner lip of the staple groove to secure the perimeter flange securely in place. The thickness of nib 60 spaces the inwardly extending lip from the perimeter rib to compensate for the thickness of the fabric on the other side. As mentioned above, this insures that the lips project inwardly in a horizontal orientation.

Figure 12:
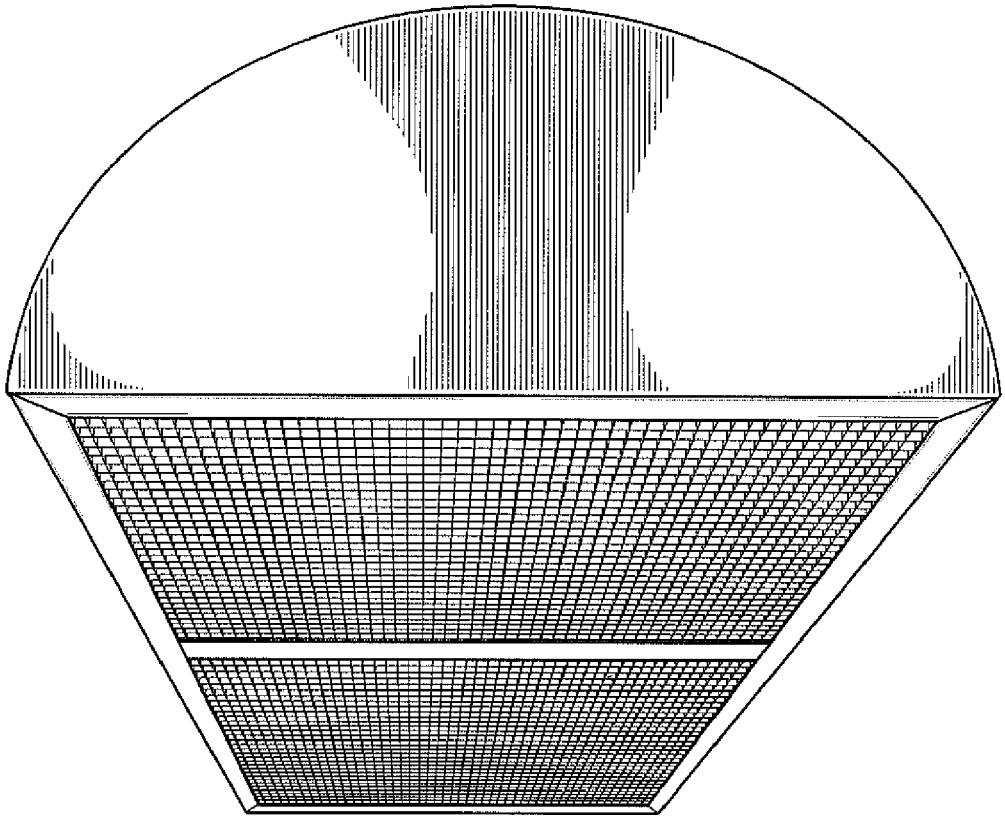
FIG. 12 is a perspective view of an awning system that embodies the present invention.
Figure 13:
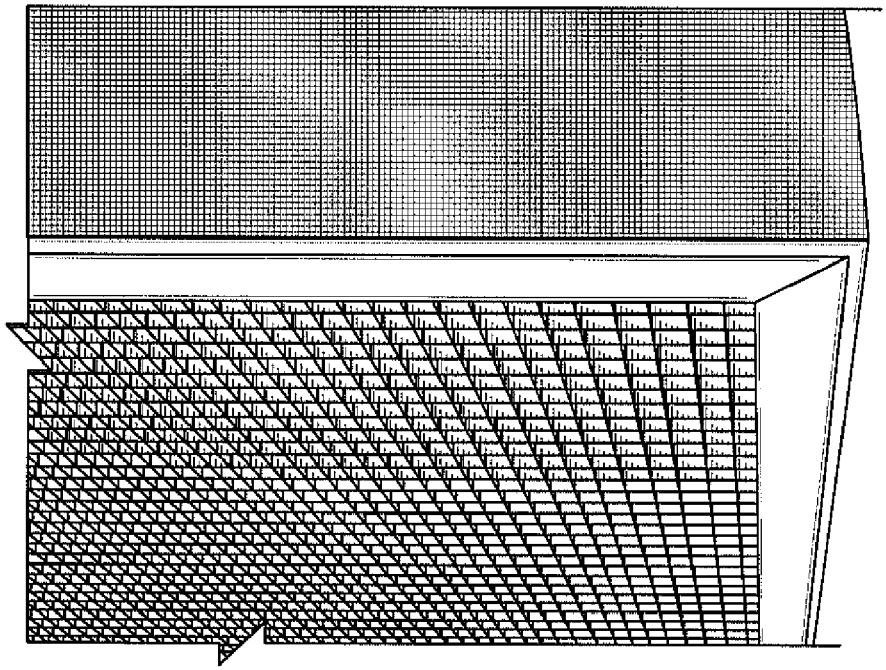
FIG. 13 is a perspective view of the awning system of FIG. 10 seen from another perspective.
Figure 14:
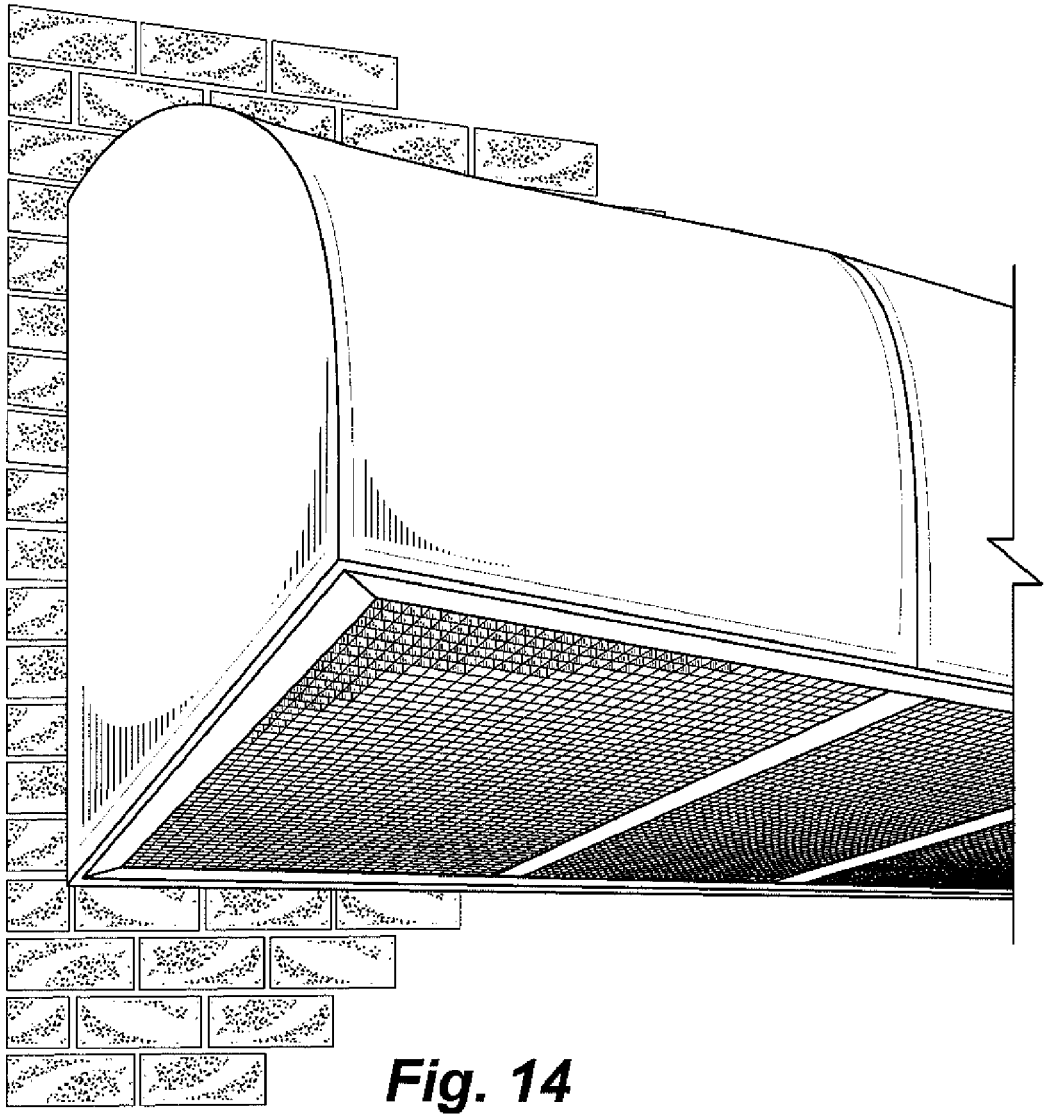
FIG. 14 is a perspective view of the awning system of FIG. 10 from yet another perspective.

FIGS. 12-14 show various views from the underside of an awning assembly provided with the egg crate panel supporting structure of this invention supporting egg crate ceiling panels. It can be seen that the system of the present invention forms a clean aesthetically pleasing underside of the awning.

Figure 15:
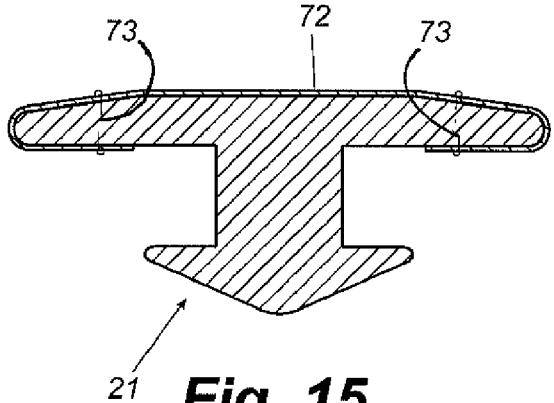
FIG. 15 is a cross-sectional view of an alternate embodiment of a fabric covered vinyl strip with sewn-on fabric covering according to another aspect of the invention.

FIG. 15 is a cross-sectional view of an alternate embodiment of a fabric covered vinyl strip according to the invention. In this embodiment, the vinyl strip 71 is covered by fabric 72 that is folded around the edges of the strip and attached with stitching 73, preferably applied with an industrial sewing machine. Sewing the fabric on the vinyl strips is considered superior to gluing, sonically welding, or other means of attachment because of its permanence and clean appearance when applied to an awning.

Figure 16:
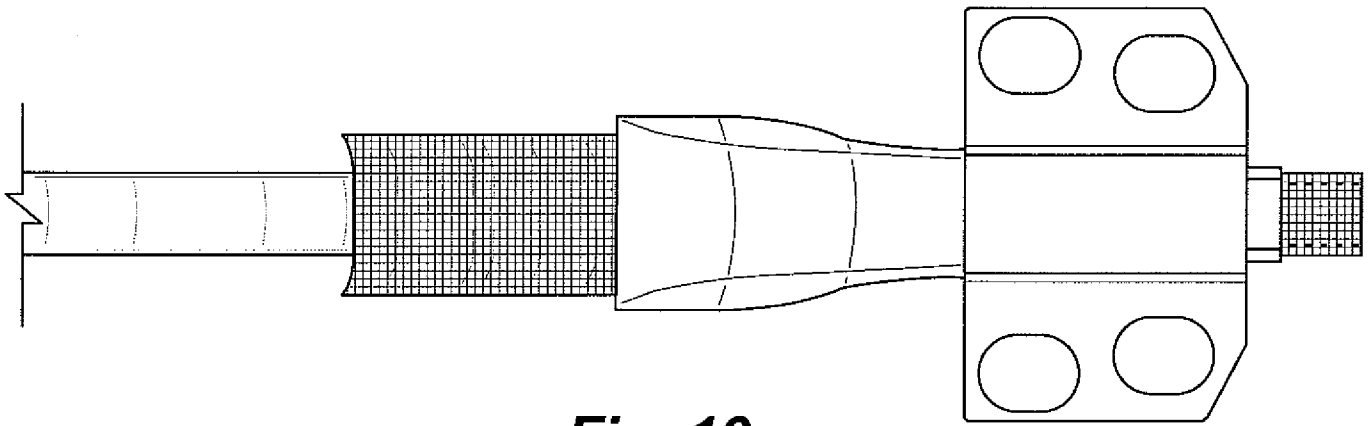
FIG. 16 is a bottom plan view of a unique sewing foot for an industrial sewing machine for manufacturing the fabric covered vinyl strips of FIG. 15.
Figure 17:
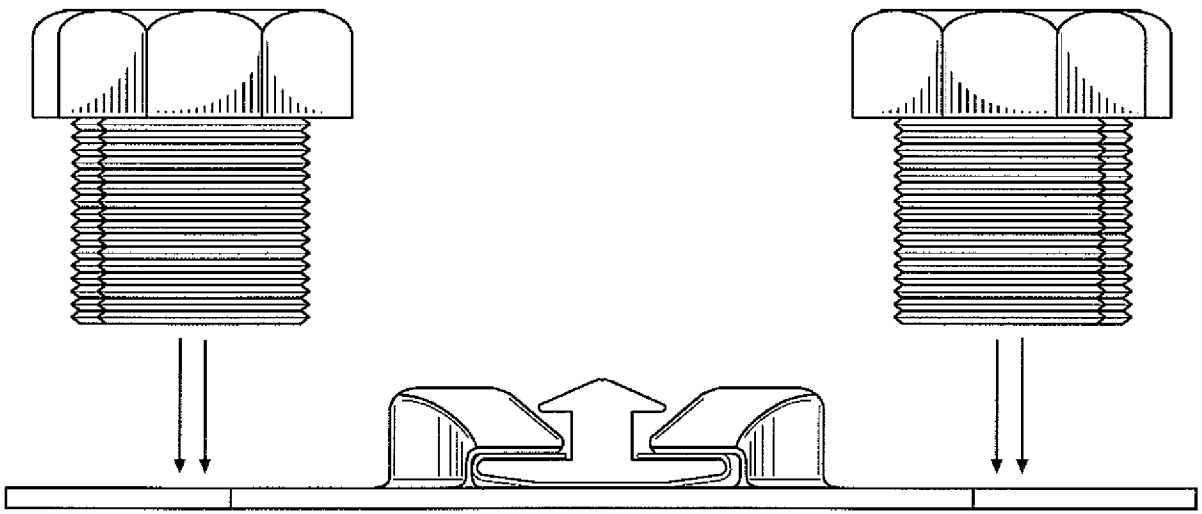
FIG. 17 is an end view of the sewing foot the foot of FIG. 16 from another viewing angle showing how the foot wraps fabric around the vinyl strip in preparation for sewing.
Figure 18:
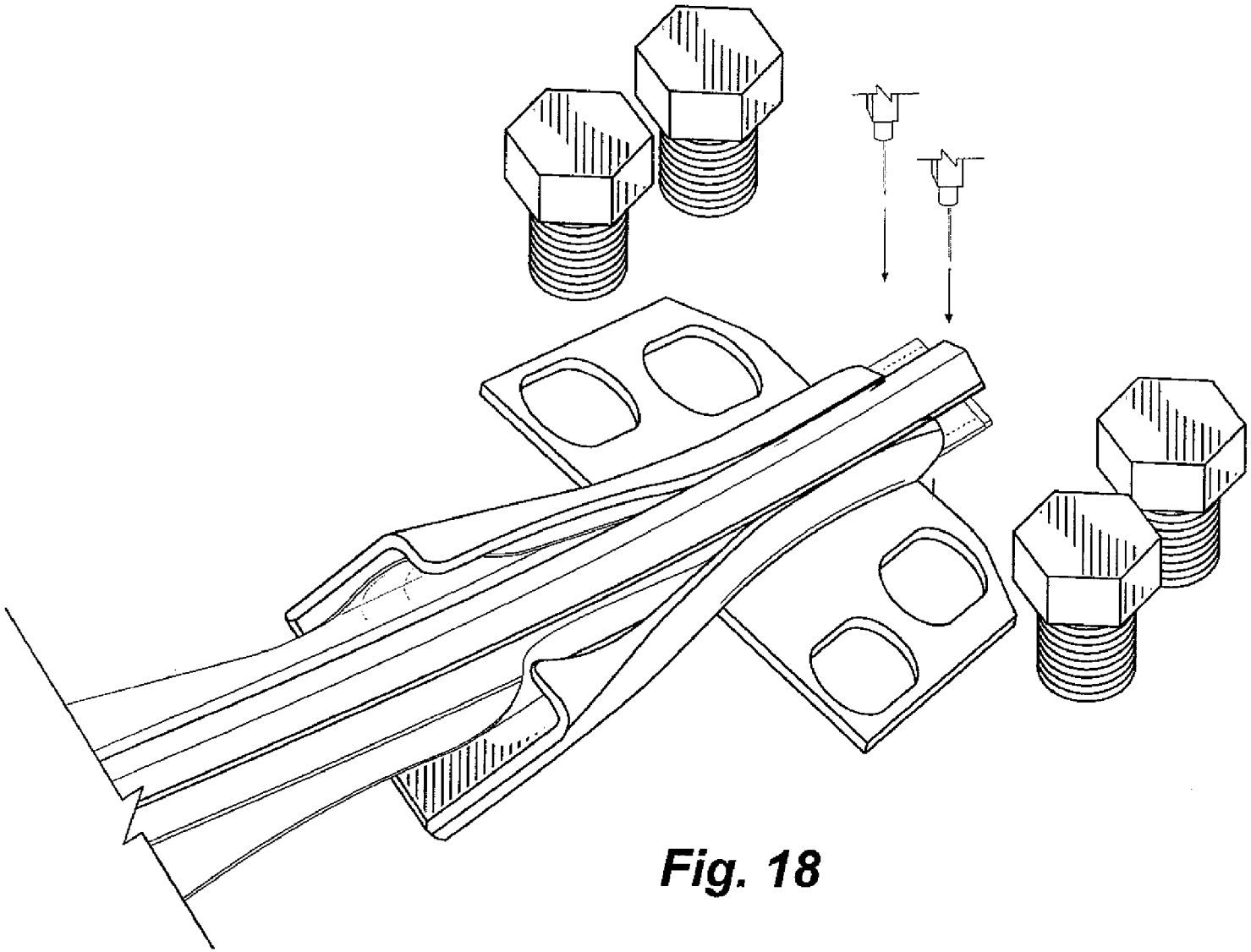
FIG. 18 is a perspective view of the foot of FIG. 16 for manufacturing the sewn fabric covered strip of FIG. 15.

FIGS. 16 through 18 illustrate one possible embodiment of a specially designed and unique sewing foot for an industrial sewing machine for applying the fabric cover to vinyl strips according to the invention. It can be seen that the vinyl strip and a strip of fabric are fed into the foot. As the combination passes through the foot, the shape of the foot causes the fabric to fold neatly around the edges of the vinyl strip and further stretches and tightens the fabric around the vinyl. Immediately after leaving the foot, the fabric is sewn to the strip by two needles of a professional double needle sewing machine. The resulting strip can then be snapped into place in the staple grooves of an awning to cover the grooves and provide either a virtually undetectable seam where the fabric matches that of the awning, or a contrasting seam where it does not. The provision of a fabric cover on the vinyl strip has many advantages over a raw vinyl strip, as discussed in more detail above.

The invention has been described herein in terms of preferred embodiments and methodologies that illustrate principles of the invention and represent the best mode known to the inventors of carrying out the invention. It will be clear to skilled artisans, however, that a variety of additions, deletions, and modifications may be made to the illustrated preferred embodiments without departing from the spirit and scope of the invention as set forth in the claims.

What is claimed is:

1. A fabric covered awning comprising:

a frame formed of interconnected ribs, at least some of said ribs having an exposed longitudinally extending staple slot;

a fabric canopy covering said frame, said fabric canopy being tucked into and secured within said longitudinally extending staple slots; and cover strips extending along said staple slots covering the tucked in portions of said fabric canopy, each of said cover strips comprising a body and an outer fabric cover secured to said body.

2. The fabric covered awning as claimed in claim 1 and wherein each said body is generally T-shaped and comprises a tang secured within a staple slot and a top portion that spans and covers the staple slot, said fabric cover overlying at least said top portion of said body.

3. The fabric covered awning as claimed in claim 2 and wherein the tang is a barbed tang.

4. The fabric covered awning as claimed in claim 2 and wherein each body is formed of a vinyl material.

5. The fabric covered awning as claimed in claim 2 and wherein said fabric cover is secured to said top portion of said body with adhesive.

6. The fabric covered awning as claimed in claim 2 and wherein said fabric cover is secured to said top portion of said body by a sonic weld.

7. The fabric covered awning as claimed in claim 2 and wherein said fabric cover is secured to said top portion of said body with stitching.

8. The fabric covered awning as claimed in claim 7 and wherein said stitching extends through said top portion and said fabric cover.

9. The fabric covered awning as claimed in claim 8 and wherein said stitching comprises two rows of spaced apart stitches.

10. The fabric covered awning as claimed in claim 7 and wherein said fabric cover overlies and wraps around beneath said top portion of said body, said stitching extending through said fabric cover on both sides of said top portion.

11. The fabric covered awning as claimed in claim 2 and wherein said fabric cover is made of a material that visually blends with the material of said fabric canopy.

12. The fabric covered awning as claimed in claim 2 and wherein said fabric cover is made of a material that visually contrasts with said fabric canopy.

* * * * *